United States Patent [19]

Suzuki et al.

[11] 4,263,884

[45] Apr. 28, 1981

[54] ELECTRONIC FUEL FEED SYSTEM

[75] Inventors: Seiko Suzuki; Sigeyuki Kobori; Kanji Kawakami; Toru Sugawara; Yoshikazu Hoshi; Satoshi Suzuki, all of Ibaraki, Japan

[73] Assignee: Hitachi, Ltd., Tokyo, Japan

[21] Appl. No.: 925,789

[22] Filed: Jul. 18, 1978

[30] Foreign Application Priority Data

Jul. 25, 1977 [JP] Japan ..... 52-88429

[51] Int. Cl.[3] ..... F02B 3/00

[52] U.S. Cl. ..... 123/487; 123/494

[58] Field of Search ..... 123/32 EA, 32 EB, 32 EC, 123/32 EJ; 73/194 VS

[56] References Cited

U.S. PATENT DOCUMENTS

| | | | |
|---|---|---|---|
| 3,818,877 | 6/1974 | Barrera et al. | 73/194 VS X |
| 3,956,928 | 5/1976 | Barrera | 123/32 EJ X |
| 3,967,596 | 7/1976 | Comley | 123/32 EA |
| 3,991,727 | 11/1976 | Kawai et al. | 123/32 EA |
| 4,121,549 | 10/1978 | Martin et al. | 123/32 EJ X |
| 4,142,407 | 3/1979 | Kuroiwa | 73/194 VS X |
| 4,148,283 | 4/1979 | Harada et al. | 123/32 EJ X |

*Primary Examiner*—Tony M. Argenbright

*Attorney, Agent, or Firm*—Craig and Antonelli

[57] ABSTRACT

An electronic fuel feed system wherein pulses generated in synchronism with the revolutions of an engine are multiplied by N, the suction air of the engine is measured by a swirl-type air flow meter, the pulses increased N times as fall within a pulse of the air flow meter are counted, and the quantity of fuel supply is calculated from the inverse number of the count value.

7 Claims, 16 Drawing Figures

ELECTRONIC FUEL FEED SYSTEM

BACKGROUND OF THE INVENTION

1. Field of the Invention

This invention relates to a fuel feed system. More particularly, it relates to an electronic fuel feed system which is the most suitable for controlling the air fuel ratio of a mixture to be sucked into the engine of an automobile.

2. Description of the Prior Art

It has been known to use a swirl-type air flow meter or a vortex-type air flow meter for the measurement of the quantity of suction air which is sucked into an automobile engine. The air flow meter is such that vortices at a frequency proportional to the velocity of flow are generated and that the generated vortices are electrically detected as pulses. Since the vortex frequency is very low, a method has been adopted wherein an analog voltage corresponding to the number of vortices is produced and wherein the fuel injection time is determined from the discharge time of the voltage. Such a method is disclosed in, for example, U.S. Pat. No. 3,818,877 granted to Ford Motor Company. Digital circuits are more easily put into the form of integrated circuits, and are more immune to noise. For such reasons, it is desirable to digitally control the quantity of fuel supply. Accordingly, there has been developed a method wherein the average flow rate of air sucked into the engine is evaluated from the inverse number of the vortex period and is divided by the engine revolutions, whereby the instantaneous flow rate of air per combustion cycle is detected so as to control the fuel injection time.

Letting N denote the engine revolutions and Qa denote the flow rate of air sucked into the engine, the instantaneous flow rate of air Q sucked into the engine per combustion cycle is indicated by the following equation:

$$Q \propto Qa/N \quad (1)$$

The output frequency of the air vibration flow meter is proportional to the flow rate of air sucked into the engine. Therefore, letting f denote the frequency and $\tau$ denote the period, the following equation holds:

$$Q \propto f/N \quad (2)$$

or $$Q \propto 1/\tau \cdot N \quad (3)$$

The instantaneous flow rate of air Q is measured with Eq. (2) or Eq. (3). In the measuring method employing Eq. (2), the number of vortices per unit engine revolution, in other words, the number of vortices per combustion cycle is small, and the measuring accuracy is insufficient. On the other hand, in the measuring method of Eq. (3) exploiting the inverse number of the vortex period $\tau$, the varying range of $\tau$ is as very wide as 50 times. This leads to the disadvantage that, when the operations are conducted by the use of a digital control device (for example, micro-computer), the number of bits of the digital control device must be made large in order to secure an operating accuracy (because the inverse number of the vortex period needs to be calculated).

SUMMARY OF THE INVENTION

An object of this invention is to provide an electronic fuel feed system which can control the air fuel ratio at a high accuracy.

According to this invention, a frequency signal synchronous with engine revolutions is multiplied by n, the number of pulses of the frequency signal increased n times is detected for a time interval between vortex signals of an air vibration flow meter which generates a frequency signal proportional to the flow rate of suction air into an engine, and the instantaneous flow rate of air sucked into the engine per combustion cycle is calculated from the inverse number of the pulse number. Fuel supplied from a fuel injection valve to the engine in synchronism with the engine revolutions is measured by the injection time control, and a desired air fuel ratio is attained.

In performing this invention, a swirl-type air flow meter, a vortex-type air flow meter or the like is used as an air vibration flow meter which measures the flow rate of air sucked into the engine.

DETAILED DESCRIPTION OF THE PREFERRED EMBODIMENT

Figure 1:
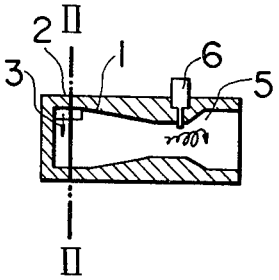
FIG. 1 is a structural view of a swirl-type air flow meter.
Figure 2:
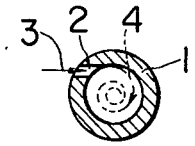
FIG. 2 is a sectional view of the air flow meter taken along II—II in FIG. 1.

Hereunder, an embodiment will be described with reference to the drawing. Referring to FIGS. 1 and 2, when an air stream 3 to be sucked into an engine is introduced from an aperture 2 which is arranged tangentially to a pipeline 1 having a circular section, a spiral vortex 4 is generated by the hydrodynamical phenomenon of the air stream 3 itself along the inner wall of the pipeline 1. The spiral vortex 4 is gradually throttled and is suddenly expanded. Then, the center of swirl of the spiral vortex 4 executes a precession as indicated at 5. As is well known, the frequency of the precession 5 of the center of swirl is proportional to the flow rate of air passing through the interior of the pipeline 1. The flow rate of air can therefore be measured by detecting the precession 5 with a sensor 6.

Figure 3:
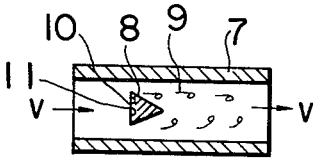
FIG. 3 is a schematic structural view of a vortex-type air flow meter.

FIG. 3 is a schematic structural view of a vortex-type air flow meter. Karman's vortex street 9 is generated behind a vortex generator 8 which is arranged in a pipeline 7. As is well known, the frequency of the Karman vortex street 9 is proportional to the velocity of flow v within the pipeline 7. The flow rate of air can therefore be measured by detecting the Karman vortex street 9 with sensors 10 and 11 which are installed in the vortex generator 8.

In this manner, the present invention employs the air vibration flow meter in which the frequency of vortices is proportional to the flow rate of suction air into the engine. As the sensor 6, 10 or 11 for the vortex flow, a hot wire, thermistor, strain gauge or the like is used. It goes without saying that the air vibration flow meters shown in FIGS. 1 to 3 are merely for the purpose of illustration and that various modifications based on the fundamental principles are contrived.

Figure 4:
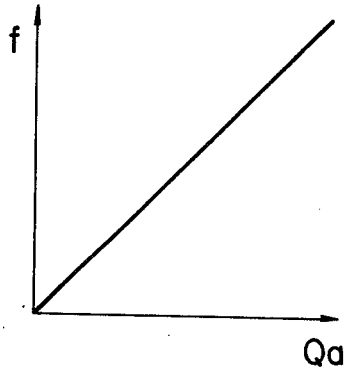
FIG. 4 is a diagram of the general characteristic of the air vibration flow meter.

FIG. 4 illustrates the general characteristic of the air vibration flow meter.

As shown in the figure, the frequency f of vortices is proportional to the flow rate Qa of suction air into the engine. The vortex frequency f is on the order of 1 KHz at the maximum flow rate of air. As described later, a control system of intermittent fuel injection synchronous with the engine revolutions is concerned, and the instantaneous flow rate of air which is sucked into the engine per combustion cycle needs to be evaluated.

A method according to this invention for measuring the instantaneous flow rate of air to be sucked into the engine per combustion cycle is as stated below.

Eq. (2) previously mentioned is reduced to:

$$Q \propto \frac{1}{\frac{N}{f}} \tag{4}$$

Measurement based on Eq. (4) is the method according to this invention for measuring the instantaneous flow rate of air Q to be sucked into the engine per combustion cycle. The number of engine revolutions N is detected in the form of a frequency signal $f_N$, which is multiplied by n by means of a frequency multiplier circuit. Then, since $N \propto n \cdot f_N$, Eq. (4) becomes as follows:

$$Q \propto \frac{1}{\frac{n \cdot f_N}{f}} \tag{5}$$

That is, the number of pulses per unit vortice in the frequency signal $n \cdot f_N$, in other words, the number of pulses per vortice period in the frequency signal $n \cdot f_N$ is detected, and the instantaneous flow rate of air Q to be sucked into the engine per combustion cycle is measured from the inverse number of the pulse number.

Figure 5:
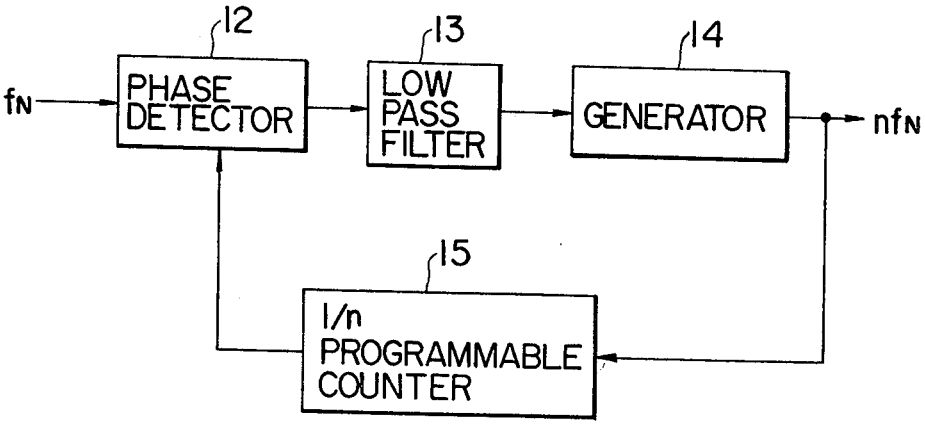
FIG. 5 is a block diagram of a frequency multiplier circuit according to this invention.

FIG. 5 is a block diagram showing the arrangement of the frequency multiplier circuit.

The frequency multiplier circuit is constructed of a phase detector 12, a low-pass filter 13, a generator 14 the frequency of which is controlled by the voltage, and a 1/n programmable counter 15. With this frequency multiplier circuit, the frequency signal $f_N$ indicative of the engine revolutions N is readily increased n times. Since the number of engine revolutions N is slower in the dynamic change than the flow rate Qa of suction air into the engine, the multiplication of the frequency signal $f_N$ can be effected at a high precision without delay.

FIGS. 6(A)–6(E) are explanatory views for elucidating the operation of this invention.

Figure 6:
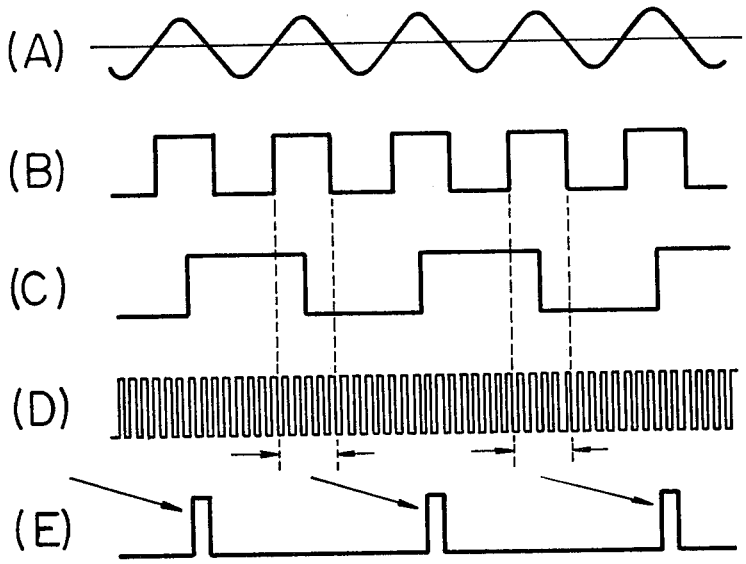
FIGS. 6(A) to 6(E) are explanatory views for elucidating the operation of this invention.

FIG. 6(A) shows a vortex waveform provided from the sensor portion of the air vibration flow meter which exhibits the frequency f proportional to the flow rate of suction air into the engine. FIG. 6(B) shows a waveform obtained in such a way that the central level of the vortex waveform in FIG. 6(A) is detected and that the vortex waves are shaped into square waves by a comparator etc. FIG. 6(C) shows the waveform of the frequency signal $f_N$ synchronous with the number of engine revolutions N. FIG. 6(D) shows the waveform of the frequency signal $n \cdot f_N$ obtained in such a way that the frequency of the frequency signal $f_N$ is multiplied by about 1,000 by means of the frequency multiplier circuit. The number of pulses of the waveform of the frequency signal $n \cdot f_N$ as corresponds to a half cycle $\tau/2$ of the shaped waveform in FIG. 6(B), that is, a half cycle of the vortex waveform in FIG. 6(A) is detected by a counter or any other means. The detection of the number of pulses is equivalent to the calculation of $n \cdot f_N/f$. Therefore, when the inverse number of the number of pulses is computed by e.g. a micro-computer, the computed value directly indicates the instantaneous flow rate Q of air to be sucked into the engine per combustion cycle. In case of an automobile, the varying range of $n \cdot f_N$ is approximately 10 times and that of f is approximately 50 times, so that the varying range of the inverse number of $n \cdot f_N/f$ is approximately 5 times. Accordingly, the computation of $n \cdot f_N/f$, i.e., the inverse number of the pulse number previously described can be executed at a high accuracy by a micro-computer which has a small number of bits. Moreover, the number of pulses can be readily set to any desired and large number by the frequency multiplier circuit as shown in FIG. 5. It is therefore possible to measure highly accurately the instantaneous flow rate Q of air to be sucked into the engine per combustion engine. The flow rate of fuel to be supplied from the fuel injection valve to the engine is controlled so as to be proportional to the instantaneous flow rate of air Q measured by such a method, whereby a desired air fuel ratio can be attained at a high precision. Fuel which is measured by the injection time control of the fuel to be injected from the fuel injection valve is supplied to the engine in synchronism with the engine revolutions. This state is illustrated by a waveform in FIG. 6(E). As indicated by arrows in the figure, the fuel is injected immediately after measuring the instantaneous flow rates of air Q and in synchronism with the engine revolutions at those times. The fuel waveform in FIG. 6(E) is therefore synchronous with the frequency signal $f_N$ in FIG. 6(C). FIGS. 6(A)–6(E) have illustrated the measuring method wherein the instantaneous flow rate Q of the air to be sucked into the engine per combustion cycle is evaluated from the inverse number of the number of pulses of the frequency signal $n \cdot f_N$ during the half cycle of the vortex. Needless to say, however, the inverse number of the number of pulses of the frequency signal $n \cdot f_N$ during one cycle or several cycles of the vortex may well be utilized by altering an operating program in the micro-computer.

FIGS. 7(A)–7(E) are further explanatory views for elucidating the operation of this invention.

Figure 7:
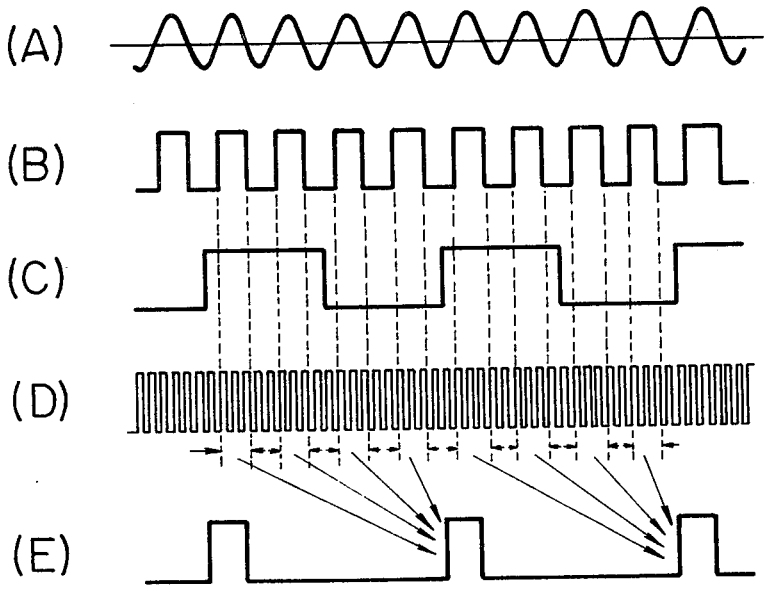
FIGS. 7(A) to 7(E) are further explanatory views for elucidating the operation of this invention.

The foregoing example in FIGS. 6(A)–6(E) concerns a case where the negative suction pressure of the engine is great and where the instantaneous quantity of flow Q of air to be sucked into the engine per combustion cycle is small. In contrast, FIGS. 7(A)–7(E) illustrate a case where the negative suction pressure of the engine is small and where the instantaneous quantity of flow Q of air to be sucked into the engine per combustion cycle is large. FIG. 7(A) shows a vortex waveform, FIG. 7(B) a shaped waveform, FIG. 7(C) the waveform of the frequency signal $f_N$, FIG. 7(D) the waveform of the frequency signal $n \cdot f_N$, and FIG. 7(E) a fuel waveform. In this case, there are many vortices relative to the number of pulses of the frequency signal $f_N$, in other words, per combustion cycle. Therefore, the calculation of the instantaneous flow rate of air Q as explained with reference to FIGS. 6(A)-6(E) can be executed several times. As a result, a careful control can be made in such a way that the instantaneous flow rate Q of air to be sucked into the engine per combustion cycle is finally determined by exploiting the mean value of the several calculated values or by weighting the respective calculated values. This state is illustrated by arrows in FIGS. 7(D) and 7(E).

Since the output signal f of the air vibration flow meter of the swirl type, the vortex type or the like is proportional to the volume flow rate of air, the instantaneous mass flow rate Qb of air to be sucked into the engine per combustion cycle is determined from Q calculated by Eq. (5), as follows:

$$Qb = \frac{k\,P}{T}\,Q \qquad (6)$$

where k denotes a constant, and P and T denote the absolute pressure and absolute temperature of air to be sucked into the engine, respectively. The flow rate of fuel to be supplied from the fuel injection valve to the engine is actually controlled so as to be proportional to the instantaneous mass flow rate of air Qb, not to the instantaneous volume flow rate of air Q. At this time, the absolute pressure P and the absolute temperature T of the air are respectively detected by a pressure sensor and a temperature sensor installed in a suction pipe, and the volume flow rate is converted into the mass flow rate. The operation of Eq. (6) is readily executed by a digital control device such as micro-computer or by any other means.

Figure 8:
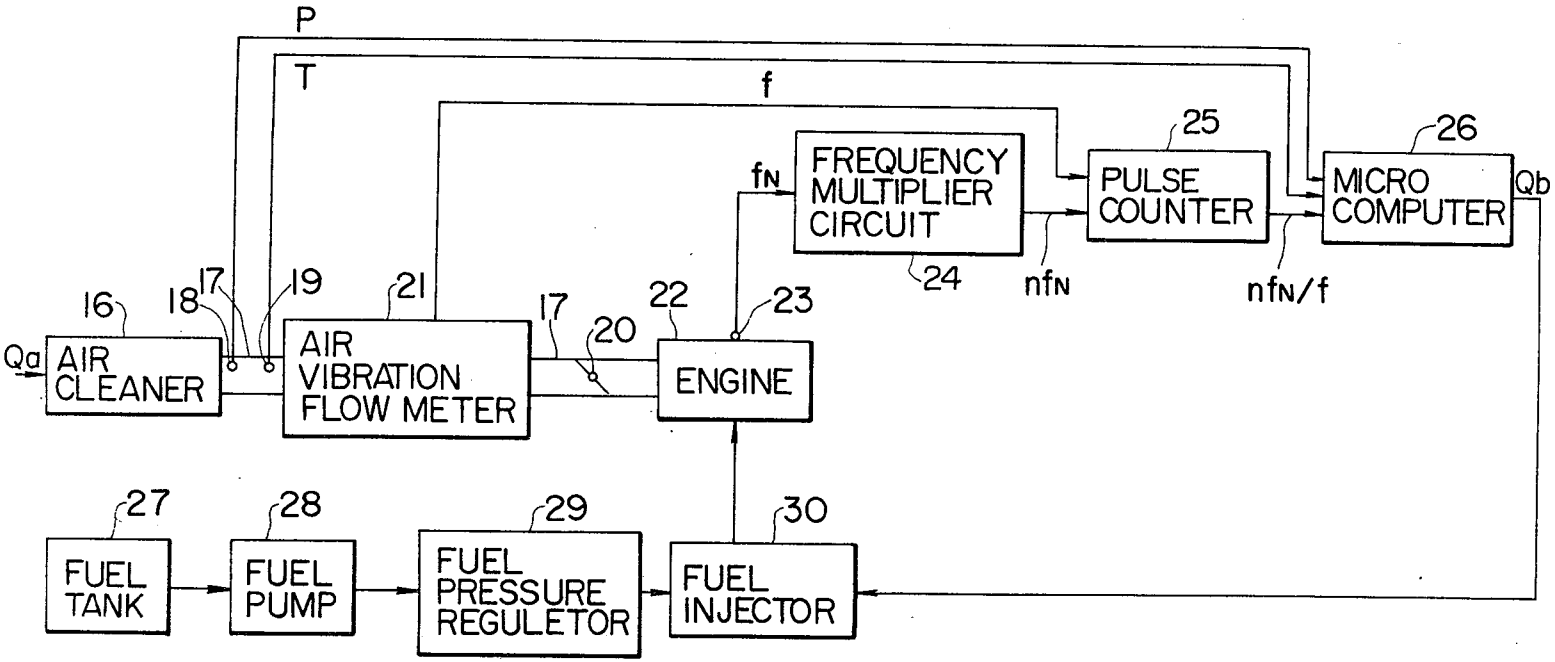
FIG. 8 is a block diagram showing an embodiment of this invention.

FIG. 8 is a block diagram showing an embodiment of this invention.

The electronic fuel feed system is constructed of an air cleaner 16, a suction pipe 17, a pressure sensor 18 and a temperature sensor 19 which are mounted in the suction pipe 17, a throttle valve 20, an air vibration flow meter 21, an engine 22, a revolution sensor 23 which detects the number of engine revolutions, a frequency multiplier circuit 24, a pulse counter 25, a micro-computer 26, a fuel tank 27, a fuel pump 28, a fuel pressure regulator 29, and a fuel injector 30.

The air stream Qa is sent to the engine 22 through the air cleaner 16, one portion of the suction pipe 17, the flow meter 21 and the other portion of the suction pipe 17. The quantity of air to enter the engine 22 is adjusted by the throttle 20. In the section between the air cleaner 16 and the flow meter 21, the absolute pressure P and the absolute temperature T are respectively detected by the pressure sensor 18 and the temperature sensor 19. The flow meter 21 is the air vibration flow meter as described before. The revolution sensor 23 delivers a frequency signal $f_N$, which is impressed on the frequency multiplier circuit 24 (constructed as shown in FIG. 5). A frequency signal $n \cdot f_N$ multiplied by n (10 in this embodiment) by the circuit 24 is transmitted to the pulse counter 25. The pulse counter 25 further receives a frequency f which is delivered by the air vibration flow meter 21. As described previously, the pulse counter 25 provides the number of pulses of the frequency signal $n \cdot f_N$ during the half cycle of the frequency f in the form of $n \cdot f_N/f$. Using this output signal and the signals P and T as input signals, the micro-computer 26 calculates the inverse number of the foregoing number of pulses. Then, the quantity Q is obtained. (Although the signals P and T have been used as correction signals, compensations at the time of starting are further considered as correction signals.) In the micro-computer 26, the operations of Eq. (5) and Eq. (6) are simultaneously executed. The instantaneous mass flow rate of air Qb obtained is sent to the fuel injector 30, and controls it so as to inject an amount of fuel corresponding to the suction air. The fuel is delivered from the fuel tank 27 by the fuel pump 28, and is fed to the fuel injector 30 through the fuel pressure regulator 29.

In this invention, the digital control device (micro-computer 26) is deliberately utilized. It is therefore possible that the fuel injection time at the preceding combustion cycle is stored in the digital control device in advance and that when the number of vortex signals per combustion cycle is small (or null), the injection time at the preceding cycle is exploited for the determination of the injection time of the particular cycle. This can realize a delicate control. Moreover, the system can be constructed by the use of a micro-computer of small number of bits.

As apparent from the above description, according to this invention, the instantaneous mass flow rate of air can be measured at a high precision, so that an electronic fuel feed system which has a high control accuracy for the air fuel ratio of a mixture can be provided.

We claim:

1. An electronic fuel feed system comprising:

(A) an engine for burning a mixture consisting of fuel and air, (B) a suction pipe for introducing the air into said engine, (C) vortex generating means mounted on said suction pipe, (D) means for detecting the generated vortices, (E) means for generating a signal synchronous with revolutions of said engine, (F) means for multiplying said signal synchronous with the engine revolutions, (G) count means for counting the output pulses of the multiplication means during the vortex period, and (H) control means for controlling a quantity of fuel supply to said engine per combustion cycle on the basis of the output of said count means.

2. An electronic fuel feed system comprising:

(A) an engine for burning a mixture consisting of fuel and air, (B) a suction pipe for introducing the air into said engine, (C) vortex generating means mounted on said suction pipe, (D) vortex detection means for detecting vortices generated by said vortex generating means and for producing pulses synchronous with the generation of said vortices, (E) engine revolution detection means for producing pulses synchronous with revolutions of said engine, (F) multiplication means for detecting the output pulses of said engine revolution detection means and for producing pulses with said output pulses multiplied, (G) count means for counting the output pulses of said multiplication means as appear between the output pulses of said vortex detection means, and (H) control means for obtaining an inverse number of the count value of said count means and for controlling a quantity of fuel supply to said engine on the basis of the inverse number value.

3. An electronic fuel feed system according to claim 2, wherein said vortex generating means comprises a pipeline having a circular section, an aperture for introducing the air of said suction pipe in a direction tangential to said pipeline, and throttling means provided on an inner side of said pipeline.

4. An electronic fuel feed system according to claim 2, wherein said vortex generating means comprises a pipeline and a vortex generator disposed within said pipeline, and sensors of said vortex detection means are installed on said vortex generator.

5. An electronic fuel feed system for controlling a quantity of fuel supply on the basis of a quantity of suction air introduced into engine, comprising:

air flow sensor for sensing the suction air introduced into the engine and for producing a pulse train, the repetition period of the pulse train being inversely proportional to the quantity of the introduced suction air;

means for generating a frequency signal in synchronism with the engine revolution;

means for multiplying the frequency of the signal from said frequency signal generating means by a predetermined rate;

means for counting the multiplied frequency signal from said multiplying means during a duration of a pulse of the pulse train from said air flow sensor; and means for controlling the quantity of fuel supply to the engine per combustion cycle on the basis of the output of said counting means.

6. An electronic fuel feed system for controlling a quantity of fuel supply on the basis of a quantity of suction air introduced into an engine, comprising:

air flow sensor for sensing the suction air introduced into the engine and for producing a pulse train, the repetition period of said pulse train being inversely proportional to the quantity of said introduced suction air;

means for generating a frequency signal in synchronism with the revolution of such engine;

means for multiplying the frequency of the signal from said frequency signal generating means by a predetermined number;

means for counting the multiplied frequency signal from said multiplying means during durations of plural pulses of the pulse train from said air flow sensor; and means for controlling the quantity of fuel supply to the engine per combustion cycle on the basis of the output of said counting means.

7. An electronic fuel feed system as claimed in claim 5 or 6, wherein the predetermined number of said multiplying means is greater than one.

* * * * *